United States Patent [19]

Wentzell

[11] 3,982,934

[45] Sept. 28, 1976

[54] METHOD OF FORMING UNIFORM DENSITY ARTICLES FROM POWDER METALS

[75] Inventor: Joseph M. Wentzell, Remsen, N.Y.

[73] Assignee: United Technologies Corporation, Hartford, Conn.

[22] Filed: May 31, 1974

[21] Appl. No.: 474,878

[52] U.S. Cl. ..... 75/208 R; 29/420.5; 75/200; 75/214; 75/223; 75/226; 164/45; 164/76; 164/132; 164/138; 204/20; 204/30; 204/48; 264/111; 264/125

[51] Int. Cl.[2] ..... B22F 3/00; B22F 3/12; B22F 3/14; B22F 3/16

[58] Field of Search ..... 264/120, 122, 125, 111; 75/226, 200, 223, 214, 208 R; 29/420.5; 427/228, 250; 204/20, 30, 48; 164/45, 76, 132, 135

[56] References Cited

UNITED STATES PATENTS

| | | | |
|---|---|---|---|
| 2,568,157 | 9/1951 | Lepp et al. | 75/223 X |
| 3,344,209 | 9/1967 | Hague et al. | 75/226 X |
| 3,455,682 | 7/1969 | Barbaras | 75/223 X |
| 3,700,435 | 10/1972 | Chandhok | 75/223 X |
| 3,841,870 | 10/1974 | Hamjian | 75/223 X |
| R28,301 | 1/1975 | Havel | 75/223 |

*Primary Examiner*—Richard E. Schafer
*Attorney, Agent, or Firm*—Edward J. Timmer

[57] ABSTRACT

The present invention provides a method and apparatus for powder metal formation in which a plated shell is formed corresponding to the appropriate calculated pre press size of the final part being formed; the electroplate shell is filled with powder metal to be formed; the shell is surrounded by a pressure transferring support media and compacted using a suitable force transmitter such as an isostatic press; and the support media is removed leaving the final product within the electroplate shell which may or may not be removed as desired.

16 Claims, 1 Drawing Figure

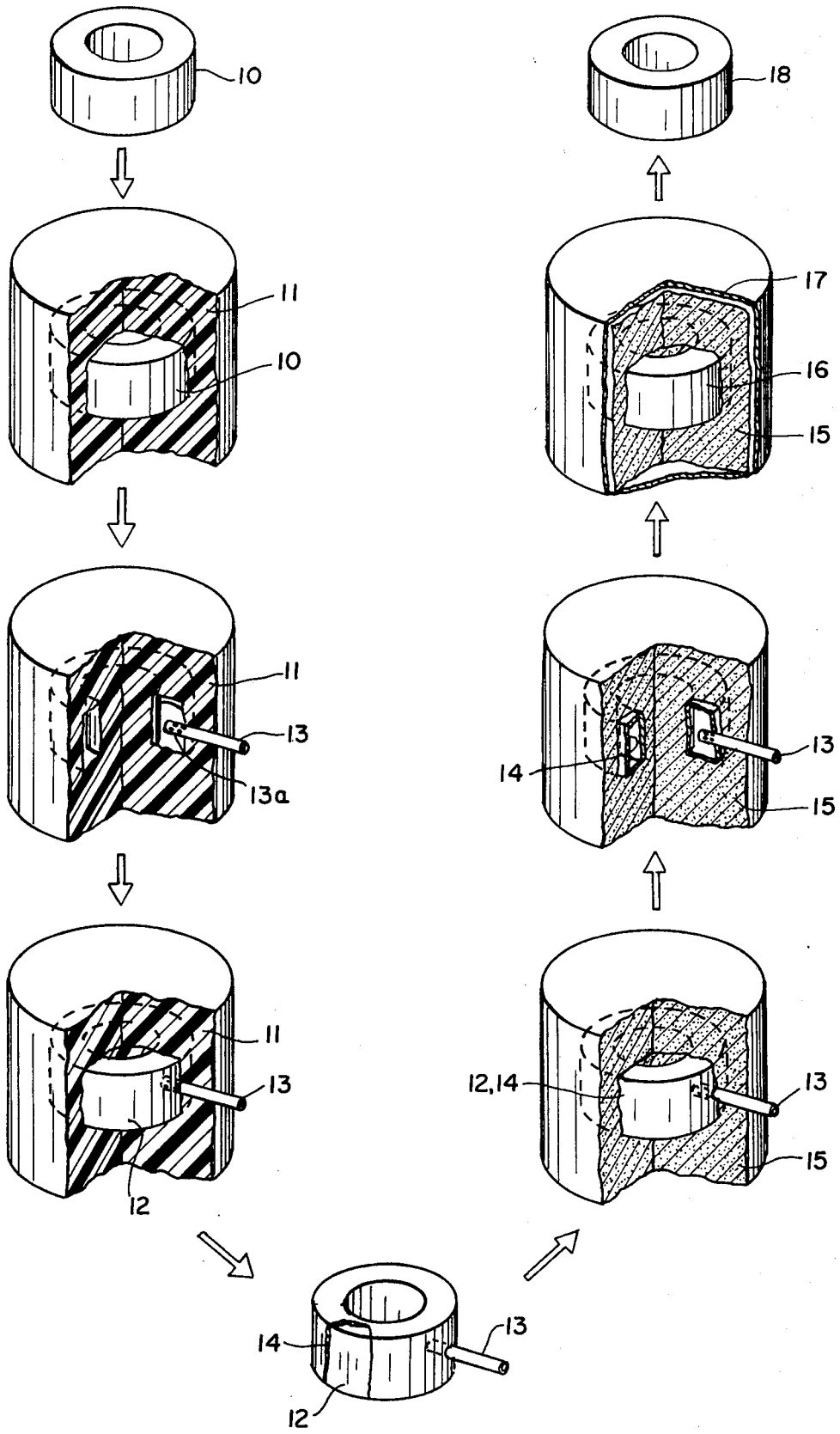
10
11
10
11
13
13a
11
13
12
14
13
12
12,14
13
15
17
16
15
18

METHOD OF FORMING UNIFORM DENSITY ARTICLES FROM POWDER METALS

This invention relates to methods of powder metal formation and particularly to a method of fabricating a container for powdered metal, filling and compressing the same.

One of the more significant problems in handling powdered metals is that of handling such powdered metals during pressing and forming. Articles of metal powder are usually prepared by placing the powder to be compressed in a die or mold and consolidating the same under pressure. Unfortunately, as is well known in the art, it is extremely difficult to obtain uniform density in objects made from powder which have variable thickness or stepped portions or which otherwise vary in cross section. The reason for this is equally well known but has remained unsolved as a practical matter. The problem is that metal powders have very little lateral flow properties and thus cannot adjust to variations in mold shape where the mold varies significantly in cross section.

An excellent example of this problem is found in the discs used to hold turbine blades in a gas turbine or "jet" engine. These discs are usually thicker toward the center than at the edges and may have several protrusions for receiving seal rings. Such discs may have varying cross sections ranging from one to about four inches or more in thickness. When such parts are attempted to be made in a pot die using conventional techniques and a normal metal powder having an assumed density of 50% with punches contoured to give the necessary 1 inch to 4 inches varying cross section, the volume represented by the 1 inch thick cross section would be compacted to 100% theoretical density while that represented by the 4 inch thick section would have been compacted only one quarter of the desired density or about 62-½% of theoretical density. The resulting product is a disc having undesirable porosity and density differentials from edge to center.

I have discovered a method and apparatus which makes it possible to solve these well known and previously insoluble problems. This invention makes it possible to form, by conventional forging or compacting, articles which have non-uniform cross sections or which are hollow and to provide finished articles which have uniform density regardless of their irregular shape.

The present invention provides a method and apparatus for powder metal formation in which a plated shell is formed corresponding to the appropriate calculated pre press size of the final part being formed; the electroplate shell is filled with powder metal to be formed; the shell is surrounded by a pressure transferring support media and compacted using a suitable force transmitter such as an isostatic press; and the support media is removed leaving the final product within the electroplate shell which may or may not be removed as desired.

Preferably I form a pattern having the dimensions of the final part multiplied by the reciprocal of the cube root of the tap density of the powdered metal to be used, form the female mold around the pattern, remove the pattern from the female mold, cast an electrically conductive material or a material which may be subsequently coated with an electrically conductive material capable of subsequent fluidization or solubilization into the female mold, extract the formed casting from the mold, electroplate the casting with a material which is not fluidizable or solubilizable with the casting material to form a shell, surround the casting having the electroplated shell thereon with a support media, remove the casting material from the shell, fill the shell with metal powder to be formed, hot isostatically press the shell and its contents to about 100% density and remove the support media. The female mold is preferably an elastomer such as a silicone rubber. Preferably the electrically conductive metal is a low melting temperature metal or metal alloy such as lead-bismuth alloy. The electroplated shell is preferably nickel or some similar metal. Alternatively, the shell may be formed by vapor depositing nickel or some similar metal on the formed casting. The support media is preferably iron powder formed around the shell and pressed to a uniform porosity prior to removing the casting and which is sintered after removal of the casting. The iron is removed by machining or both after the superalloy product has been formed. Alternatively the support media can be ceramic grit, liquid or a second cast material which would be plastic or liquid at the pressing temperature.

In the foregoing general description of my invention I have set out certain objects, purposes and advantages of my invention. Other objects, purposes and advantages will be apparent from a consideration of the following description and the accompanying drawing showing a flow sheet of the method of this invention.

In the flow sheet I have illustrated the practice of this invention as preferably practiced.

A pattern 10 is formed having the dimensions of the final part multiplied by the reciprocal of the cube root of the tap density of the superalloy powder ultimately to be formed. In this example a jet engine ring to be formed of a powdered superalloy generally known in the trade as Hastelloy R-235 and having the nominal composition 0.15% C, 15.5% Cr, 2.5% Co, 5.5% Mol, 2.5% Ti, 2.0% Al, 10% Fe, and the balance N.

The pattern 10 is surrounded by silicone rubber and the rubber is set to form a female mold 11.

The female mold 11 is removed from pattern 10 and filled with molten lead-bismuth alloy to form an electrically conductive casting 12 having the form of the original pattern 10. Preferably a thin wall nickel tube 13 is inserted in the casting 12 prior to solidification. This tube 13 is provided with holes **13*a*** in the sidewall of the inserted end.

After the lead-bismuth alloy casting 12 has solidified it is removed from mold 11 and electroplated with nickel to a suitable thickness e.g. 0.002 inch to 0.003 inch to form a shell 14. The shell 14 and casting 12 are surrounded by iron powder which is pressed using conventional pressing techniques to a controlled density substantially the same as that of the superalloy to be formed, e.g. if the superalloy powder has a density of 70% of theoretical then the iron is compressed to 70% of its theoretical density to form a support media 15.

The lead-bismuth alloy casting 12 is melted and removed through tube 13 and the iron powder of support media 15 is sintered in conventional manner.

The interior cavity of shell 14 is acid cleaned and filled with the powdered superalloy (Hastelloy R.235) 16 to be formed.

The whole compact is canned and the can 17 evacuated and sealed. The evacuated and canned compact isostatically hot pressed to 100% theoretical density.

The can 17 and sintered powdered iron support media 15 are removed by any conventional means including machining and pickling to provide a finished article 18 of 100% density superalloy.

In the same manner ceramic grit or other powdered materials may be compacted, as in the case of iron powder used in the foregoing example, to a porosity substantially equal to that of the superalloy to be compacted around the shell 14, the castry 12 removed, the shell filled with the material to be compacted and the whole assembly pressed to a finished article.

While I have illustrated and described certain presently preferred practices and embodiments of this invention in the foregoing specification it will be understood that this invention may be otherwise embodied within the scope of the following claims.

I claim:

1. A method for forming a powder metal article of uniform density comprising the steps of:

a. forming a metallic shell on form having the appropriate prepress size of the desired article, the form being made of a selectively removable material;
b. surrounding the form having the metallic shell thereon with a support media;
c. selectively removing the form from the metallic shell, the shell remaining surrounded by the support media and defining a cavity having the appropriate prepress size of the desired article;
d. filling the cavity defined by the shell with powder metal;
e. pressing the support media and filled shell to compact the powder metal into the desired article; and
f. removing the support media from the compacted article, the article having the metallic shell thereon.

2. The method of claim 1 including the additional step of removing the metallic shell from the compacted article.

3. The method of claim 1 wherein the form is provided in the appropriate prepress size of the desired article by:

a. providing a pattern having the dimensions of the desired article multiplied by the reciprocal of the cube root of the tap density of the powder metal to be formed;
b. forming a female mold around the pattern;
c. removing the female mold from the pattern, the mold having developed the desired strength and having a cavity in the shape of the pattern;
d. filling the mold cavity with casting material;
e. solidifying the casting material in the mold cavity; and
f. removing the formed casting from the mold, the casting having the shape of the pattern.

4. The method of claim 1 wherein the metallic shell is formed by electroplating an electrically conductive form.

5. The method of claim 1 wherein the metallic shell is formed by vapor deposition.

6. The method of claim 1 wherein the metallic shell is nickel.

7. The method of claim 1 wherein the support media is powdered material pressed to a percentage of theoretical density substantially equal to the percentage of theoretical density of the powder metal to be formed.

8. The method of claim 1 wherein the support media is sintered iron powder.

9. The method of claim 1 wherein the support media is ceramic grit.

10. The method of claim 1 wherein the support media is liquid material.

11. The method of claim 1 wherein the powder metal is superalloy powder.

12. The method of claim 1 wherein the support media and filled shell are compacted by hot isostatic pressing.

13. The method of claim 1 wherein the support media and filled shell are compacted by forging.

14. A method of forming a powder metal article of uniform density comprising the steps of:

a. providing a nonconductive form in the appropriate prepress size of the desired article, the form being made of a selectively removable material;
b. coating the form with a layer of conductive material, said conductive material being selectively removable;
c. electroplating the conductive layer to form a metallic shell;
d. surrounding the form having the conductive layer and metallic shell thereon with a support media;
e. selectively removing the form and conductive layer from the metallic shell, the shell remaining surrounded by the support media and defining a cavity having the appropriate prepress size of the article to be formed;
f. filling the cavity defined by the shell with powder metal;
g. pressing the support media and filled shell to compact the powder metal into the desired article; and
h. removing the support media from the compacted article, the article having the metallic shell thereon.

15. The method of claim 14 including the additional step of removing the metallic shell from the compacted article.

16. The method of claim 14 wherein the form is provided in the appropriate prepress size of the article to be formed by:

a. providing a pattern having the dimensions of the desired article multiplied by the reciprocal of the cube root of the tap density of the powder metal to be formed;
b. forming a female mold around the pattern;
c. removing the female mold from the pattern, the mold having developed the desired strength and having a cavity in the shape of the pattern;
d. filling the mold cavity with nonconductive casting material;
e. solidifying the casting material in the mold cavity; and
f. removing the formed casting from the mold, the casting having the shape of the pattern.

* * * * *